United States Patent [19]

Kosiak

[11] 4,011,862

[45] Mar. 15, 1977

[54] MASSAGING SUPPORT APPARATUS

[76] Inventor: Michael Kosiak, 3305 Skycroft Circle, Minneapolis, Minn. 55418

[22] Filed: Nov. 17, 1975

[21] Appl. No.: 632,179

Related U.S. Application Data

[63] Continuation-in-part of Ser. No. 545,726, Jan. 31, 1975, abandoned.

[52] U.S. Cl. ..... 128/58

[51] Int. Cl.[2] ..... A61H 11/00

[58] Field of Search ..... 128/58, 57, 24.3, 33

[56] References Cited

UNITED STATES PATENTS

| | | | |
|---|---|---|---|
| 1,214,306 | 1/1917 | Hoard | 128/57 |
| 2,285,958 | 6/1942 | Wheelock | 128/57 |
| 2,461,102 | 2/1949 | Ackerman | 128/57 |
| 3,464,406 | 9/1969 | Kunce | 128/57 |
| 3,687,133 | 8/1972 | Grubelic | 128/58 |
| 3,835,844 | 9/1974 | Lang | 128/33 |

FOREIGN PATENTS OR APPLICATIONS

| | | |
|---|---|---|
| 1,046,900 | 7/1953 | France |

*Primary Examiner*—Lawrence W. Trapp
*Attorney, Agent, or Firm*—Robert C. Baker

[57] ABSTRACT

This apparatus for supporting a human body for improved blood circulation comprises a frame, a pair of endless flexible belt assemblies having transverse roller members, means for mounting the belt assemblies on the frame to form laterally juxtaposed body support spans each consisting essentially of an upper stretch of the roller members of a belt assembly, means for moving the belts to cause the roller members to move along the body support span of each belt assembly, and track means for supporting at least some of the roller members of the laterally juxtaposed body support spans in an angular position toward a V-shaped relationship for a partially cradling body support effect.

25 Claims, 11 Drawing Figures

MASSAGING SUPPORT APPARATUS

This application is a continuation-in-part of my abandoned application Ser. No. 545,726, filed Jan. 31, 1975.

This invention relates to apparatus for supporting a human body for improved blood circulation, especially to facilitate blood movement through those tissues pressed by the body against the apparatus.

Known prior art is set forth in the following United States Letters Patents, none of which approaches the problem nor solves it in the manner taught herein: Hoard U.S. Pat. No. 1,214,306; Noble U.S. Pat. No. 1,322,720; Prien U.S. Pat. No. 2,052,656; Wheelock U.S. Pat. No. 2,285,958; Miller U.S. Pat. No. 2,310,106; Niblack U.S. Pat. No. 2,359,933; Curtis U.S. Pat. No. 2,395,040; Ackerman U.S. Pat. No. 2,461,102; Gaudette et al. U.S. Pat. No. 2,543,493; Tarr U.S. Pat. No. 2,841,139; Kubicek U.S. Pat. No. 3,050,050; Smith U.S. Pat. No. 3,128,761; Kunce U.S. Pat. No. 3,464,406; Kilcup U.S. Pat. No. 3,480,007; Madsen U.S. Pat. No. 3,587,569; Simjian U.S. Pat. No. 3,662,749; Laskowitz U.S. Pat. No. 3,675,644; and Grubelic U.S. Pat. No. 3,687,133. Also known and fully distinguished over is French Pat. No. 1,046,900, published Dec. 9, 1953.

Invalids and others who remain at rest in one position for a long period of time are apt to develop sores or ulcers on those portions of their body bearing the body weight. Nature blesses the average individual with an excellent nervous system which prompts him to shift his rest position rather frequently, whether that rest position is one of sitting or lying down. Frequent shifts of position facilitate capillary blood movement through tissues in those portions of the body released by a shift of position from bearing the body's weight. This in turn saves the average individual from the development of sores or ulcers in those portions. But paraplegics and others similarly afflicted are either incapable of shifting position or forget to do so because no nervous system warnings of discomfort are experienced.

Normal cellular metabolism as effected by blood movement through those tissues compressed by the weight of a body at rest has been a much sought after goal. The sitting position is especially troublesome because very little tissue (fat or muscle) extends between the ischial tuberosities and the skin covering therefor. That tissue is normally severely compressed and starved of blood by the weight of a person who remains stationary in a sitting position. But, according to this invention, the movement of blood through capillaries of tissue subjected to compression by body weight is facilitated without a critical necessity for manually or otherwise shifting or elevating, or in any way noticeably moving, the person who is in a resting position (whether sitting or lying down) on the apparatus. Optionally, the apparatus hereof may be adjusted to effect noticeable movement of the person on it; but such is not critically necessary when practicing the invention.

The apparatus of this invention is designed to support a human body in a partially cradled and varied pressure manner to facilitate the movement of blood through those tissues of the body as pressed by the weight of the body against the apparatus. This apparatus comprises:

i. a frame;

ii. a pair of endless flexible belt assemblies; each belt assembly comprises a plurality of transverse roller members arranged in substantially parallel relationship;

iii. means for mounting each belt assembly on the frame so that each forms a body support span consisting essentially of an upper stretch of roller members of the belt assembly; the body support span of one belt assembly is laterally juxtaposed to the body support span of the other belt assembly;

iv. means for moving each belt assembly to cause the roller members thereof to move in sequence along the length of the body support span formed by the belt assembly; thus, those tissues of a body as pressed by its weight against a body support span are subjected to a stroking action of alternate pressure and release of pressure as effected by the movement of the roller members; and v. track means for supporting at least a portion of the roller members of one body support span in an angular relationship to at least a portion of the roller members of the other span at least during times when the weight of a body rests in part on each such portion; this angular relationship is such that the medial juxtaposed ends of the roller members of each such portion are relatively more displaced downwardly than the outside lateral ends thereof; thus, a body resting in part on each body support span of the apparatus is partially cradled in its position of rest.

The foregoing and other features and benefits of the invention will further be explained and described with the aid of a drawing, made a part hereof, wherein.

Figure 7:
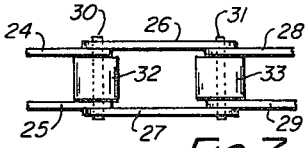
Figure 8:
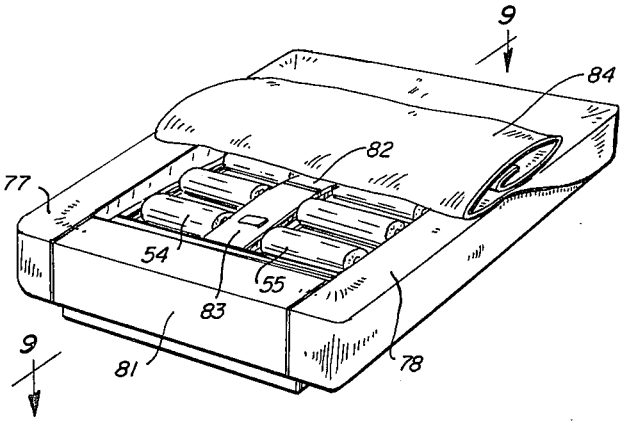
Figure 9:
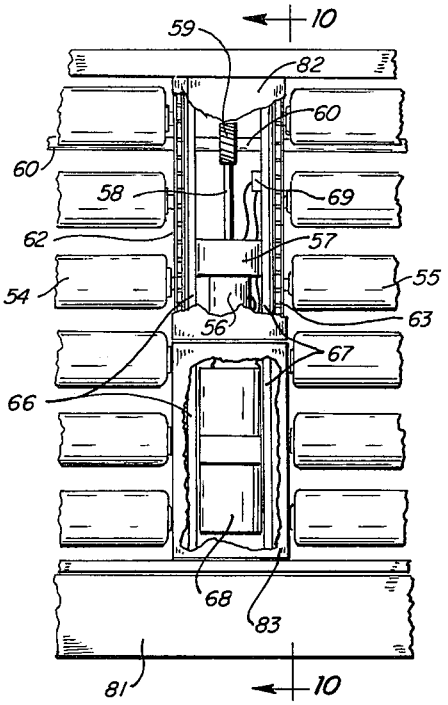
Figure 10:
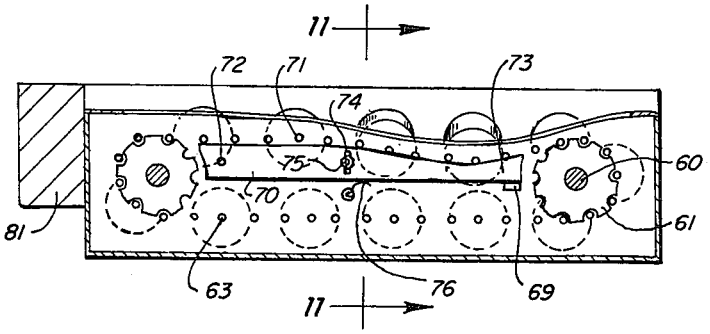
Figure 11:
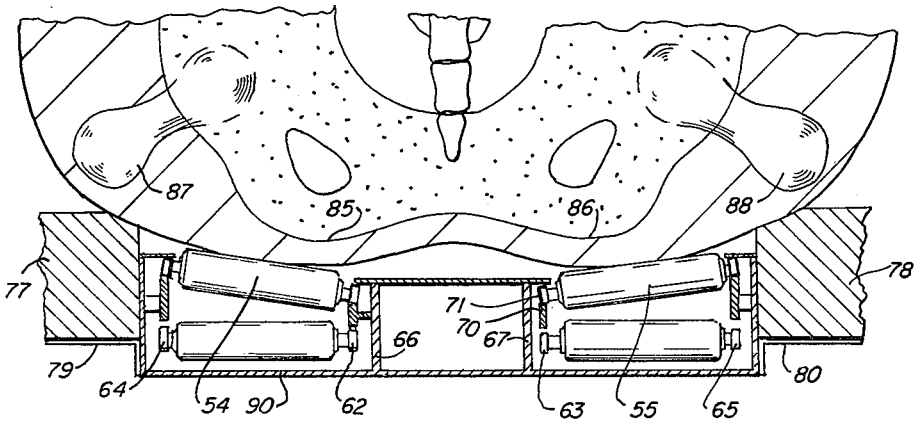

FIG. 7 is a schematic plan view showing features of an endless link chain useful for the invention; and FIG. 8 through 11, inclusive, are schematic views of an alternate seat member of this invention—FIG. 8 being a perspective view, and FIGS. 9 through 11 being sectional views (with parts broken away) each taken along lines of immediately preceding figures as marked on the drawing, with FIG. 11 additionally including a section through a buttocks.

Figure 1:
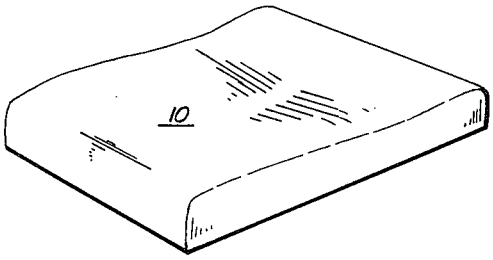
FIG. 1 is a schematic perspective view of a support platform for a human body.

The showing in FIG. 1 is intended to be illustrative of a platform 10 for supporting a human body whether that platform comprises the seat of a chair, or the support surface of a bed or any other structure. The teachings herein are useful in such environments; but the seat of a chair will most frequently receive particular attention in describing basic elements and arrangements characteristic of the invention.

Under most conditions, the platform 10 is covered with a flexible sheet or layer of material—such as a layer of plastic film or leather or cloth. The covering is especially desirable from the standpoint of providing an easily cleaned surface. Thick padded cover materials are not desirably employed, for they interfere with the effectiveness of the selective application and release of pressure as hereinafter discussed.

Figure 2:
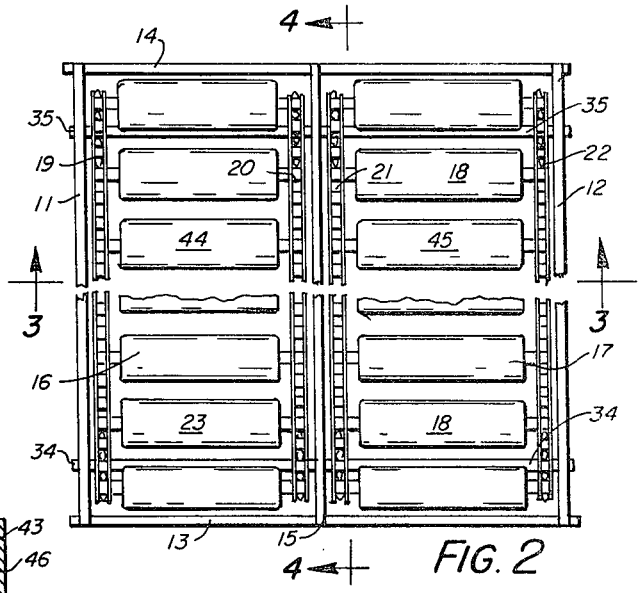
FIG. 2 is a schematic top plan view, partially broken away, of the structure of the support platform with its flexible cover removed and with underlying parts omitted from the view so as to permit clarity in the showing.

Referring particularly to FIG. 2, the frame for the support platform suitably comprises girders in the nature of panels or narrow strips of rigid material. These may be formed of plastic, wood, or metal; but aluminum is preferred. Illustratively, side girders 11 and 12 are united to a front or head girder 13 and a rear or foot girder 14 in any suitable manner to form a complete peripheral or perimeter frame. A medial girder or panel 15, intermediate the side panels, suitably extends from the front 13 to rear 14 panel and divides the structure into two main sections or parts, which preferably are about equal in size. The perimeter frame may vary in length, as desired for its ultimate use, and is suitably mounted on known frame elements of a chair or bed in a mannner to form a seat or bed, as desired.

A continuous or endless flexible belt assembly is mounted in each part of the frame structure separated by the medial girder 15. These belt assemblies are broadly designated by the numerals 16 and 17 in the drawing. Since both belt assemblies may be and preferably are substantially identical, emphasis in describing their nature will be concentrated on the belt assembly 17 at the right in FIG. 2.

Belt assembly 17 comprises a plurality of transverse roller members 18. Rollers 18 are arranged in substantially parallel relationship at intervals of spaced character along the entire extent of the composite endless belt 17. A proximate spaced relationship between roller members is preferred in that it gives an individual resting upon the roller members the sensation that he is supported by a platform even though there are spaces between the roller members. Generally, the width of spaces between roller members 18 will not normally be greater than approximately the diameter of the roller members; but greater spacing may be employed where it is not objectionable if a person resting on the apparatus is subjected to noticeable up and down movement. Usually the spacing will be about that just sufficient to permit each roller to freely rotate without abutting against any adjacent roller at any point along the travel of the belt assembly. While each roller member is mounted for free rotation about its axis, suitably on roller bearings, there is no need for powered rotation of the roller members. Further, the preferred roller members are substantially cylindrical; but rollers of varied radial or longitudinal contour may be employed, if desired. For maximum benefit in terms of facilitating healthy blood movement, roller members formed out of stiff or rigid materials (such as wood, metal or hard plastics) should be used in preference to those formed out of resilient or soft materials. The diameter of preferred roller members should be at least about 1 or 2 centimeters up to about 4 or 5 centimeters. Rollers of about 3 centimeters diameter give excellent results in terms of comfort and in terms of facilitating blood movement.

The exact structural details for a composite endless belt assembly having freely rotatable transverse roller members may vary. Illustratively, each belt assembly 16 and 17 comprises a pair of endless link chains between which the roller members are mounted. The pair of link chains 19 and 20 carry the rollers 23 for the belt assembly 16; and the pair of chains 21 and 22 carry the rollers 18 for belt 17. These link chains may take the character of an ordinary bicycle chain. Each link (see FIG. 7) is separated and consists of two parts 24 and 25; 26 and 27; 28 and 29. Links overlap and are united by pins 30 and 31. A cylinder or spacing sleeve or enlargement 32 and 33 on each pin serves to separate and connect the two parts of each link. Preferably, cylinders 32 and 33 exhibit little resistance to rotation about their pin axis, and serve as cooperating means for contact engagement with and movement over a track guide, as will be explained. Each roller 18 and 23 is suitably fixed between endless link chains by extending the shaft of a pin connector and using that shaft as the axis for the roller.

Each composite flexible belt assembly 16 and 17 is mounted on the frame so that each forms a body support span. A body support span consists essentially of an upper stretch of the roller members of a belt assembly; and in FIG. 2, the body support spans are formed by the visible rollers there shown. The body support span of one belt assembly 16 is laterally juxtaposed to the body support span of the other belt assembly 17. This places the medial ends (nearest medial girder 15) of the roller members 23 of one span in medial juxtaposed relationship to the medial end of the roller members 18 of the other span. (But the rollers of one span need not be in perfect end-to-end relationship with the rollers of the other span; they may be in staggered relationship, or with alternate rollers omitted, if desired.) The spacing distance between the spans of roller members at the medial portion 15 of the apparatus should be kept to a minimum consistent with the necessary strength of structural features and the support contact to be experienced by a person on the apparatus. Generally, the medial spacing should not exceed approximately 12 centimeters (5 inches); and preferably, it is no greater than about 8 or 10 centimeters. Very desirable it is to employ the smaller spacing distances (e.g., 8 centimeters or less) between the end medial portions of the juxtaposed rollers. However, it is not critical to maintain the spacing distance between the medial ends at a level below that of the average spacing between ischial tuberosities of individuals. The angularity for the rollers, as will be explained further below, supports a sitting person to some extent along side portions of his buttocks. This is characterized herein as a partially cradled support. It relieves the bottom end of the ischial tuberosities from receiving the whole weight of the mass of one's body as conventionally experienced when sitting on a flat surface.

Figure 4:
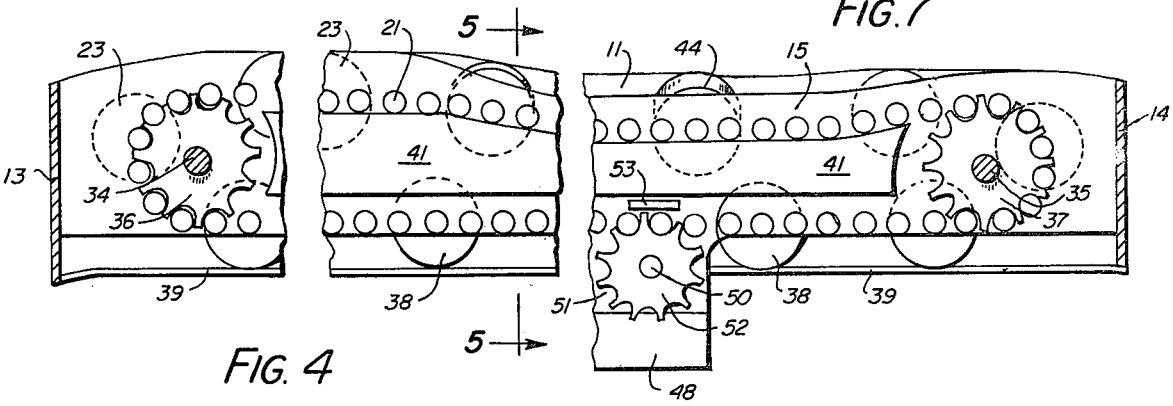
FIG. 4 is a schematic cross sectional view, partially broken away, taken on line 4—4 of FIG. 2, and particularly illustrates a track means and cooperatively associated elements of the apparatus.

Referring particularly to FIGS. 2 and 4, an illustrative non-limitative mounting for the endless belt assemblies 16 and 17 will be discussed. The endless link chains of each composite belt assembly are suitably entrained about sprockets carried on shafts 34 and 35 near the front and rear of the frame illustrated in FIG. 2. Shafts 34 and 35 are mounted for relatively free rotation in side girders 11 and 12 and medial girder 15. Illustratively, the endless link chain 21 is shown in FIG. 4 to be entrained about sprockets 36 and 37. Other sprockets on shafts 34 and 35 for chains 19, 20, and 22 are of similar nature. The sprocket wheels suitably are rigidly fixed to the shafts 34 and 35 so that rotation of one sprocket wheel will effectively cause rotation of the shaft carrying it as well as all sprocket wheels along that shaft. Further, the interlocking of the endless link chains on the sprocket wheels effectively causes the sprockets on shaft 34 to rotate when the sprockets on shaft 35 are rotated; and vice versa. The power for such rotation is transmitted through the endless link chains.

While the shafts 34 and 35 are illustrated as unitary shafts which extend completely across the frame of the apparatus, it is also contemplated that the shaft carrying the sprockets for one composite endless belt assembly, for example, belt assembly 16, may be separate and independent from the shaft carrying the sprockets for the other belt assembly 17. Further, separate and independent shafts may be tilted or placed at a position of angularity to each other so as to cause the entire length of a body support span formed by the upper stretch of a belt assembly to be sloped downwardly toward the medial portion 15 of the apparatus.

Figure 5:
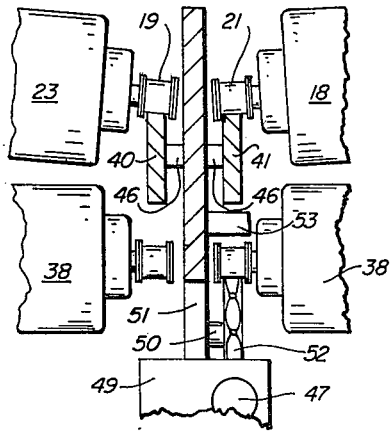
FIG. 5 is a schematic cross sectional view, partially broken away, taken on line 5—5 of FIG. 4, and particularly illustrates features of the system for moving the roller members of the apparatus.

The mounting of the endless belt assemblies 16 and 17 in the frame of the apparatus is normally accomplished in a manner to permit the roller members of the belt assemblies to be shifted in position with respect to the basic elements of the frame. In other words, the endless link chains are not mounted in a taut condition. Because of the non-taut or slack mounting condition, the lower stretch of an endless belt assembly (see rollers 38 in FIGS. 3, 4 and 5) would be expected to sag downwardly. This can be prevented by using a retaining means, such as a strip or band 39 extending from the front 13 to rear 14 girders, over which the lower roller members roll as they travel along their lower stretch. Alternately, the link chains may be supported by a ledge or strip along their lower stretch of travel.

To maintain the upper stretch of non-taut flexible endless belt assemblies in a position to form a comfortable body support span, and to control their position as the weight of an individual is applied thereto, requires special track means between the ends of the upper stretch forming the body support span. Illustratively, end sprocket wheels (such as wheels 36 and 37 in FIG. 4) suitably perform a support function at each end of the mounted belt assemblies; but intermediate those end sprocket wheels, track means of some sort is needed for supporting the upper stretch of rollers of the flexible belt assemblies in proper position to accomplish the improved supporting of a human body as taught herein.

Figure 3:
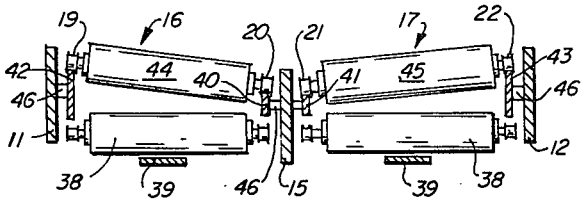
FIG. 3 is a schematic cross sectional view taken on line 3—3 of FIG. 2 and particularly illustrates the angular relationship of roller members of the apparatus.

Referring to FIGS. 3 and 4, an illustrative track means at the medial juxtaposed side, or inside edge portion, of the belt assemblies 16 and 17 suitably comprises contoured rail members 40 and 41. The contour of these rail members is illustrated more particularly in FIG. 4, where a side view of rail 41 is shown. To be observed is that the upper edge of rail 40 serves as the guide rail or surface over which the medial endless link chain 20 is guided in its movement; and the upper edge of rail 41 performs like function for link chain 21. The upper edge of the track rails suitably is slanted or sloped toward the medial part of the apparatus; and the cylindrical spacer elements (see 32 and 33 in FIG. 7) of the link chains cooperatively rest and slide, or even rotate, as the link chains transverse the length of the rail members.

Especially to be noted (see FIG. 4) is the varied height and the depressed path or contour for at least a portion of the medial track 41. (Medial track 40 is essentially identical to track 41, but a mirror image of it as mounted on the apparatus.)

Lateral or outside edge tracks 42 and 43 (see FIG. 3) may or may not be shaped to exhibit a similar contour to that illustrated for track 41. Whether or not the lateral track members 42 and 43 are similar in general shape to tracks 40 and 41, the relative height location for tracks 42 and 43 will be above that for at least a portion of the length of tracks 40 and 41. Thus, the arrangement of the track members 40, 41, 42, and 43 is such as to cause at least some of the rollers (such as the rollers marked 44 and 45 in FIGS. 2 and 3, and the roller marked 44 in FIG. 4) to assume an angular relationship to each other. This angular relationship is such that the medial juxtaposed ends of at least some of the roller members are relatively more displaced downwardly than the outside lateral ends of those rollers. In this manner a partially cradled support for a body is formed. The endless link chains 19, 20, 21 and 22 cooperatively move or slide upon the upper edge of the structures characterized as the track means as the composite belt assemblies are moved.

Suitably, the track members 40, 41, 42, and 43 are mounted or fixed in spaced condition to the frame girders 11, 15, and 12 by pins 46 or similar fastener elements.

As illustrated in FIG. 4, the medial girder 15 is suitably contoured or shaped so that it does not extend upwardly beyond the approximate height of roller members at the medial portion of the apparatus. Indeed, preferred it is to maintain the height of medial girder 15 below the height of the rollers at their medially inward ends.

It is emphasized that a significant feature of the track means is that of causing a condition of angularity between laterally juxtaposed roller members along at least some part of the body support spans formed by the composite belt assemblies. However, this condition of angularity (such as illustrated in FIG. 3) prevails primarily when the weight of a body rests in part on each body support span of the apparatus. It may prevail at all times, but it must prevail when a body is resting in part on both support spans. In other words, the condition of angularity may disappear when no weight presses the upper stretch of the belt assemblies against the track means (such as track members 40 and 41). Of course, permanent angularity may be built into the apparatus by tilting each body support span toward the medial portion of the apparatus, as noted hereinabove. Greater comfort is gained, however, when the rollers intermediate the ends of a body support span are flexed or torqued into a condition of angularity different from a relatively horizontal angular relationship between the roller members at terminal end portions of the juxtaposed support spans. This is especially true when the apparatus is designed to be used as a seat for a chair. It is more comfortable to rest one's thighs on a relatively flat or horizontal surface than on sloped surfaces tending to force one's thighs together.

The sloping of the roller members, such as roller members 44 and 45, need not be especially great to cause a pronounced effect of comfort and freedom from the effect of supporting the entire weight of one's upper body on one's ischial tuberosities. Even a slope as little as one degree from the horizontal for each juxtaposed roller can be useful to distribute some of the weight away from direct impact on the ischial tuberosities. Such a slope places the juxtaposed rollers at approximately 178° to each other. Slopes in excess of 20° from the horizontal are unnecessary and not particularly comfortable. In most cases a slope from about 2° to 8° or possibly 10° from the horizontal will be employed; slopes of such magnitude have a pronounced effect in terms of distributing body weight away from thin tissue areas, particularly for the sitting individual, and are well within what might be called a reasonable comfort range. From a sitting standpoint, the angular relationship contributes toward distribution of the pressures for support of the body along the sides of the buttocks.

A critical feature of the invention is the fact that the composite belt assemblies 16 and 17 are moved by power means so that the roller members of each belt assembly are caused to move in sequence along the length of the body support span forward by the belt assembly. This movement of the roller members more or less subjects every portion of a person's body, as pressed by the person's weight against the support span, to a stroking action. The stroking action is caused by the alternate support by a roller and lack of support by a roller as it moves underneath the person's body. It causes an alternate pressure and release of pressure on the portions of the body in contact with the apparatus; and it also forcibly moves blood through body tissues stroked. Further, the fact that the support pressure is limited to the portion of the circumference of the roller member in contact with the body means that the portions of the person's body between roller members are free of support pressure and can undergo capillary flow of blood. All of this contributes toward freedom from the development of sores and ulcers as a result of sitting or lying down in a position of rest on the apparatus for long periods of time. Both the cradling effect of the angularly disposed rollers and the movement of those rollers play a part in contributing to healthy capillary blood flow. The cradling effect tends to distribute support pressures on portions of the buttocks (or side parts of a prone body) where the tissue between bones and skin is relatively thick. Such tissue has a greater ability to take up blood than a very thin layer of tissue. The stroking action enhances relatively significant blood movement in such relatively thick tissues.

The power train for effecting movement of the endless belt assemblies need not be of such ambitious character as to require special precautions against power hazards. It might normally be expected that electrical motors of substantial power would be needed to effect the necessary movement of the endless belt assemblies forming the support structure of the invention. Surprisingly, it is possible to accomplish satisfactory movement of the endless belt assemblies (which exhibit relatively low frictional resistance to movement) by using a battery powered electrical motor requiring very little voltage and amperage—for example, no more than about ten volts and no more than about one ampere. In short, a suitable power or motive source may be self contained as part of the device, require no grounding, and yet be effective for reliable operation for long periods such as 12 or 16 hours or more. Varied mechanical arrangements for power input may be employed. Each endless belt may be mounted for movement (slower or faster or in reverse direction) independently of the other. The power input to each can vary. A suitable arrangement for the device illustrated is as follows: Power from a rapidly whirling small electrical motor 47, energized by batteries in a battery recess 48, is fed through a gear speed reduction system 49 to a main drive shaft 50 (suitably mounted on a depending ear part 51 of the medial brace 15). Drive shaft 50 carries the main drive sprocket 52 which engages one of the endless link chains (such as chain 21). Cross members such as cylinders 32 and 33 (see FIG. 7) of the link chain are maintained in engaged entrainment with recesses in the sprocket gear 52 by a foot cam 53 beneath which the endless link chain is forced in its travel. Cam 52 is fixed to the medial girder or brace 15 of the apparatus.

The gear reduction system 49 suitably slows the effective rate of movement of the endless belt assemblies 16 and 17 to that which is barely perceptible. A rate as low as a centimeter per minute can be satisfactory to provide the blood movement results espoused herein. Even lower rates of movement may be satisfactory to save some persons from sores and ulcers as they remain essentially stationary in a sitting or lying position on the apparatus. Faster rates of movement are also possible (although usually unnecessary); and rates of movement as fast as a centimeter per half minute, or even a centimeter per second may be used with success (but with concomitant increase of power consumption, which makes excessively fast movements undesirable). Even intermittent movement may be employed, if desired.

The essential point to recognize is that the movement of the roller members of each belt assembly is accomplished along the support span formed by the belt assembly; and this movement is at least sufficient to cause alternate application and release of support pressures on each point of the body pressed against the support span.

Figure 6:
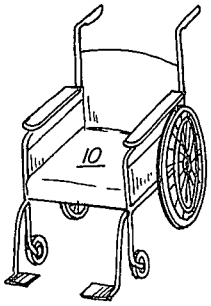
FIG. 6 is a schematic perspective view of a wheelchair equipped with a seat according to the invention.

The apparatus of the invention is especially useful as a seat member. Truckers and others who sit and drive long distances can gain benefits from sitting on a seat formed as taught herein while driving those distances. Invalids will find the teachings herein especially valuable for wheelchairs. A wheelchair such as illustrated in FIG. 6 suitably comprises a seat member, as taught herein, mounted on a frame carried by main drive wheels and having pivotable stabilizer wheels. Such chairs also include a back member and foot rests. Frequently the main drive wheels are hand powered through hand wheels, as illustrated.

An especially useful seat member is illustrated in FIGS. 8 through 11. The laterally juxtaposed belt assemblies, formed of a plurality of rollers 54 and 55, are moved by motor 56 acting through a drive linkage. The drive linkage comprises gear reduction system 57 which rotates a drive shaft 58 carrying a worm gear. A drive gear 59 is rotated by the worm gear of the drive shaft; and gear 59 in turn rotates a cross shaft 60 carrying the sprocket wheels (e.g., wheel 61 in FIG. 10) which engage and move the endless link chains 62, 63, 64 and 65. To be noted is that two medial girders 66 and 67 extend in spaced relationship from each other from the front to the back or rear part of the base frame. Between these girders (and therefore between the belt assemblies comprised of rollers 54 and 55) is located the motor 56 and the drive linkage. Further, a battery package 68 for energizing the motor is also located between the spaced medial girders 66 and 67. (Of course, the motor, drive linkage, and also the battery package, may be positioned laterally or anteriorly or beneath the juxtaposed belt assemblies, if desired.)

The actuation of movement of the belt assemblies is suitably accomplished in response to the weight of a body on the apparatus. Specifically, a pressure actuated switch 69 may complete the circuit for the flow of electricity to motor 56 from battery 68 whenever switch 69 is closed as a result of someone sitting on the apparatus. Medial contoured track 70, which supports the upper stretch 71 of endless link chain 63 may be mounted on medial girder 67 for a limited floating relationship. For example, track 70 may be pivotally mounted at one end by bolt 72 to girder 67 so as to permit slight movement for the opposite end 73 of track 70. At end 73 is carried the pressure element for actuating switch 69. The pivot movement for track 70 is limited by any suitable means, such as by the abutment of edges of slot 74 against immovable bolt 75 fixed to girder 67. The end 73 of track 70 is biased, as by a spring 76, into a normally upward position where switch 69 remains open.

Padded support members 77 and 78 are laterally juxtaposed outwardly from each body support span formed by the rollers 54 and 55. These padded members 77 and 78 are suitably mounted on rigid or metal shelf members 79 and 80 which extend outwardly from lateral elements of the base frame 90. Shelf members 79 and 80 may be used to rest the composite seat member on side brace elements of a chair. If desired, a padded front support member 81 may be fixed along the front edge of the composite seat structure. To conceal and protect the motor 56 and the drive linkage, a removable cover plate 82 may be employed. Similarly, a removable cover plate 83 may protect the battery assembly 68. Any suitable thin flexible cover 84 (shown folded back in FIG. 8) may be removably fastened over the composite seat structure for appearance purposes or sanitary reasons.

As illustrated in FIG. 11, the weight of a seated person is supported by the apparatus at a slightly angular relationship to that flatly under his ischial tuberosities. The movement of the belt assemblies at such locations facilitates tissue blood flow. The padded edges 77 and 78 under trochanters 87 and 88 contribute to a psychological impression of comfort, but do not apply significant pressures in those areas to interfere with satisfactory tissue blood flow.

Preferably, the movement of the roller members of the apparatus hereof is accomplished from front to back along the support spans of a seat structure (or foot to head for a bed). Also, the rollers of each span are preferably moved in the same direction; but they may be moved in opposite directions, if desired.

While the invention has been described with particular reference to specific structural details illustrated in the drawing, it is to be recognized that variations from the specific illustrated structural details are possible without departing from the essential character of the invention as set forth in the appended claims.

That which is claimed is:

1. Apparatus for supporting a human body in a partially cradled and varied pressure manner to facilitate the movement of blood through those tissues of the body as pressed by the weight of the body against the apparatus, said apparatus comprising:

i. a frame;

ii. a pair of endless flexible belt assemblies, each said belt assembly comprising a plurality of transverse roller members arranged in substantially parallel relationship;

iii. means for mounting each said belt assembly on said frame so that each forms a body support span consisting essentially of an upper stretch of said roller members thereof, said body support span of one said belt assembly being laterally juxtaposed to said body support span of the other said belt assembly;

iv. means for moving each said belt assembly to cause said roller members thereof to move in sequence along the length of said body support span formed thereby, whereby those tissues of a body as pressed by its weight against a said span are subjected to a stroking action of alternate pressure and release of pressure as effected by said movement of said roller members; and v. track means for supporting at least a portion of said roller members of one said span in an angular relationship to at least a portion of the roller members of the other said span at least during times when the weight of a body rests in part on each said portion, said angular relationship being such that the medial juxtaposed ends of those said roller members of each said portion are relatively more displaced downwardly than the outside lateral ends thereof, thereby to partially cradle a body resting in part on each said span.

2. The apparatus of claim 1 wherein said means for mounting each said belt assembly on said frame allows for flexible shifting of the path of movement by the belt assembly and the rollers thereof as the weight of a body is applied upon said body support spans.

3. The apparatus of claim 1 wherein said means for mounting each said belt assembly on said frame provides for slack and shifting of position of each said belt assembly with respect to said frame, and wherein a lower stretch of said belt assembly is supported against sagging downwardly by retaining means.

4. The apparatus of claim 1 wherein said medial juxtaposed ends of said roller members of each said portion are adapted to be displaced downwardly from the lateral ends thereof a distance which places said roller members at an angle between 1° and 20° from the horizontal.

5. The apparatus of claim 1 wherein said angular relationship between said medially juxtaposed ends of said roller members of each said portion is an angular relationship different from that angular relationship formed between roller members at the end portions of said juxtaposed spans.

6. The apparatus of claim 1 wherein said track means comprises a rail member at the medial juxtaposed side portion of a said one belt assembly and wherein said one belt assembly comprises an endless link chain to which said roller members of said one belt assembly are affixed, said endless link chain being equipped with cooperating means for movement on said rail member.

7. The apparatus of claim 1 wherein said means for moving each said belt assembly comprises a self contained power source mounted on said apparatus.

8. The apparatus of claim 1 wherein said means for moving each said belt assembly effects movement of said roller members of each said belt assembly in the same direction.

9. The apparatus of claim 1 wherein said roller members of each said belt assembly are substantially nonresilient.

10. The apparatus of claim 1 wherein each said belt assembly comprises a pair of endless link chains between which said roller members are mounted, at least said link chains at the medial juxtaposed ends of said roller members being equipped with cooperating elements for movement along said track means.

11. The apparatus of claim 1 wherein each said belt assembly comprises a pair of endless link chains between which said roller members are mounted for free rotary movement, and wherein said means for mounting each said belt assembly on said frame comprises sprocket wheels about which said link chains are entrained.

12. The apparatus of claim 11 wherein said means for moving each said belt assembly comprises a drive sprocket engaging a said link chain and wherein said drive sprocket is powered through a speed reducing gear by a motor energized by a power source mounted on said apparatus.

13. The apparatus of claim 12 additionally comprising a foot cam for maintaining said link chain engaged with said drive sprocket.

14. The apparatus of claim 1 wherein said means for moving each said belt assembly is actuated by the weight of a body supported on said apparatus.

15. The apparatus of claim 14 wherein said chair comprises a wheelchair.

16. The apparatus of claim 1 wherein said means for moving each said belt assembly comprises a motor and drive linkage mounted medially between said belt assemblies.

17. The apparatus of claim 1 additionally comprising padded support members laterally juxtaposed outwardly from each said body support span.

18. The apparatus of claim 1 wherein said frame comprises a chair having a seat member and wherein said seat member comprises each said body support span.

19. The apparatus of claim 18 wherein said padded support members are mounted on a shelf member extending outwardly from said frame.

20. Apparatus for supporting a human body for improved blood circulation, comprising a frame, a pair of endless flexible belt assemblies having transverse roller members, means for mounting said belt assemblies on said frame to form laterally juxtaposed body support spans each consisting essentially of an upper stretch of said roller members of a said belt assembly, means for moving said belt assemblies to cause the roller members thereof to move along said body support spans thereof, and track means for supporting at least some of said roller members of said laterally juxtaposed body support spans in an angular position toward a V-shaped relationship for a partially cradling body support effect.

21. The apparatus of claim 20 wherein said means for mounting each said belt assembly on said frame allows for flexible shifting of the path of movement by the belt assembly and the rollers thereof as the weight of a body is applied upon said body support spans.

22. The apparatus of claim 20 wherein said means for mounting each said belt assembly on said frame provides for slack and shifting of position of each said belt assembly with respect to said frame, and wherein a lower stretch of said belt assembly is supported against sagging downwardly by retaining means.

23. The apparatus of claim 20 wherein said means for moving each said belt assembly is actuated by the weight of a body supported on said apparatus.

24. The apparatus of claim 20 wherein said V-shaped relationship obtains only when the weight of a body is supported upon said body support spans.

25. The apparatus of claim 20 wherein said V-shaped relationship obtains at all times.

* * * * *

UNITED STATES PATENT AND TRADEMARK OFFICE

CERTIFICATE OF CORRECTION

PATENT NO. : 4,011,862

DATED : March 15, 1977

INVENTOR(S) : Michael Kosiak

It is certified that error appears in the above-identified patent and that said Letters Patent are hereby corrected as shown below:

Column 2, line 56, "FIG." should read --FIGS.--.
Column 5, line 25, "chaIns" should read --chains--.
Column 7, line 17, "forward" should read --formed--.
Claim 15, first line thereof, "claim 14" should read --claim 18--;
Claim 19, first line thereof, "claim 18" should read --claim 17--.
Title, "MASSAGING SUPPORT APPARATUS" should read --INTERMITTENT PRESSURE RELIEF SUPPORT--.

Signed and Sealed this

Seventh Day of June 1977

[SEAL]

*Attest:*

RUTH C. MASON
*Attesting Officer*

C. MARSHALL DANN
*Commissioner of Patents and Trademarks*